US007547244B2

(12) United States Patent
Fletcher

(10) Patent No.: US 7,547,244 B2
(45) Date of Patent: Jun. 16, 2009

(54) SONIC RAZOR BLADE SHARPENER

(75) Inventor: Charles J. Fletcher, 15 Seminole Ct., Fredon Township, Newton, NJ (US) 07860

(73) Assignee: Charles J. Fletcher, Newton, NJ (US)

( * ) Notice: Subject to any disclaimer, the term of this patent is extended or adjusted under 35 U.S.C. 154(b) by 0 days.

(21) Appl. No.: 11/933,635

(22) Filed: Nov. 1, 2007

(65) Prior Publication Data

US 2008/0248731 A1 Oct. 9, 2008

Related U.S. Application Data

(60) Provisional application No. 60/921,446, filed on Apr. 3, 2007.

(51) Int. Cl.
*B24B 41/00* (2006.01)

(52) U.S. Cl. ..... 451/8; 451/11; 451/165

(58) Field of Classification Search ..... 451/8, 451/11, 165
See application file for complete search history.

(56) References Cited

U.S. PATENT DOCUMENTS 1,540,078 A 6/1925 Long
1,588,322 A 6/1926 McAdoo
1,594,246 A 7/1926 Dechert
2,092,187 A * 9/1937 Schaf, Jr. ..... 451/165
2,094,722 A 10/1937 Sandford
2,458,257 A 1/1949 Donovan
2,476,463 A * 7/1949 Snyder ..... 451/415
2,735,231 A * 2/1956 Simjian ..... 451/113
4,122,602 A * 10/1978 Sastri et al. ..... 30/346.5
4,122,603 A * 10/1978 Sastri ..... 30/346.5
5,036,731 A 8/1991 Fletcher
5,556,321 A * 9/1996 Kasahara et al. ..... 451/5
5,983,756 A * 11/1999 Orloff ..... 76/104.1
6,030,281 A 2/2000 Cozzini et al.
6,506,106 B2 1/2003 Fletcher

* cited by examiner

*Primary Examiner*—Maurina Rachuba
(74) *Attorney, Agent, or Firm*—Connolly Bove Lodge & Hutz LLP

(57) ABSTRACT

An apparatus for sharpening one or more razor blades secured within a holder is disclosed. The holder includes a head for retaining the one or more razor blades in a cutting position and a handle affixed to the head. A housing includes a razor slot adapted to receive the head. A sharpening assembly disposed within the housing includes a sharpening member positioned adjacent the razor slot. The sharpening member is adapted to engage the one or more blades in the cutting position. A motor assembly is also disposed within the housing and is adapted to transmit a high frequency vibration to the sharpening assembly.

11 Claims, 3 Drawing Sheets

SONIC RAZOR BLADE SHARPENER

PRIORITY

Priority is claimed to U.S. provisional application Ser. No. 60/921,446, filed on Apr. 3, 2007, the disclosure of which is incorporated herein by reference in its entirety.

BACKGROUND OF THE INVENTION

1. Field of the Invention

The field of the present invention is sharpeners for hand held safety razors.

2. Background

Hand held safety razors used for shaving hair from the human body generally include a razor head attached to handle. The razor head generally includes one or more individual blades, with multiple blades being arranged in parallel, and is frequently pivotally attached to the handle. Typically, the razor blades are capable of a maximum of between four and twelve close shaves, and sometimes more depending on the coarseness of the hair being shaved. Thereafter the cutting edge of the blade becomes so dull that the user must either change blades, or in the case of disposable razors, discard the dull razor for a new one.

Sharpeners for hand held safety razors are known in the prior art. A hand operated sharpener is disclosed in U.S. Pat. No. 5,036,731, the disclosure of which is incorporated by reference in its entirety, which greatly extended the useful life of hand held razors. Although effective, the hand operation of this sharpener requires stroking a hand held razor fore and aft in precise motions, similar to the motion of shaving a human face, in order to achieve the best results.

An automated sharpener is disclosed in U.S. Pat. No. 6,506,106, the disclosure of which is incorporated by reference in its entirety. This automated sharpener is essentially an device which mechanizes the fore and aft strokes of the previous hand held sharpener. Automation of the sharpening process reduces the amount of time needed for sharpening and makes the process more consistent. While this automated process presents a significant advance over the manual sharpener, the basic sharpening method is essentially the same for both the manual and automated method. In addition, the motorized portion of the automated sharpener makes the overall device somewhat bulky, generally larger, and possibly more expensive than necessary.

SUMMARY OF THE INVENTION

The present invention is directed toward an apparatus for sharpening one or more razor blades secured within a holder, wherein the holder includes a head for retaining the one or more razor blades in a cutting position and a handle affixed to the head. A housing includes a razor slot adapted to receive the head, with a sharpening assembly and a motor disposed within the housing. The sharpening assembly includes a sharpening member positioned adjacent the razor slot such that the sharpening member engages the one or more razor blades as the razor blades are in the cutting position. The motor assembly is coupled to the sharpening assembly and adapted to transmit a high frequency vibration to the sharpening assembly.

One or more optional configuration features may be incorporated into the sharpening apparatus, either singly or in combination. In one optional configuration, the motor assembly may comprise a motor, a motor arm coupling the motor to the sharpening assembly, a motor shaft, and a weight eccentrically mounted to the motor shaft. With such a configuration, the motor assembly is enabled to generate the high frequency vibration used to sharpen the razor blades.

In a second optional configuration, a cradle assembly is mounted to the housing and adapted to engage the distal end of the handle to hold the head in the cutting position against the sharpening member. The cradle assembly may include an arm affixed to and extending away from the housing and a cradle secured in sliding relationship to the arm such that the cradle is movable toward and away from the housing. The cradle is adapted to engage the distal end of the handle to hold the head in the cutting position. With such a configuration, the sharpening apparatus may be used with disposable safety razors, having different handle sizes. As a further option, a spring may be included which biases the cradle toward the housing In a third optional configuration, the sharpening apparatus further includes control circuitry and an activation switch. The control circuitry is electronically coupled to and controls power to the motor. The activation switch is electronically coupled to the control circuitry and is used to activate the control circuitry. Additionally, the control circuitry may include a timing circuit which is activated by the activation switch and used to control power to the motor assembly for a predetermined period of time.

In a fourth optional configuration, the motor may be powered by a rechargeable battery.

Accordingly, an improved razor blade sharpener is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
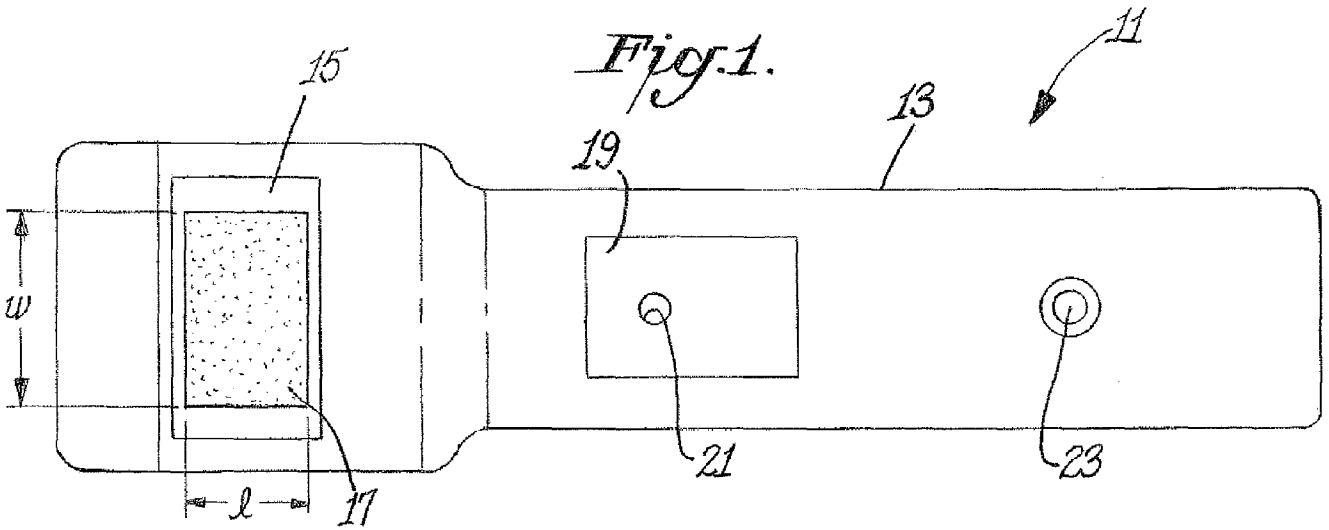
FIG. 1 is a top elevation view of a razor sharpener.

Turning in detail to the drawings, FIG. 1 illustrates the housing 13 of a razor sharpener 11 and the razor slot 15 in the housing, through which the sharpening member 17 is exposed. The housing 13 may be constructed of any appropriate material, and is preferably constructed from a plastic or a metal. The sharpening member 17 is rectangular in shape and has a width, w, which is preferably just smaller than the razor blade width of most common disposable safety razors. Preferably, the width, w, approximately 1.025"±0.010". The length, l, of the sharpening member is preferably approximately 1". This preferred size allows the outer lips of the razor head to straddle the sharpener, thereby providing a track effect. This preferred size also ensures that the razor cutting remains engaged with the sharpening member during the sharpening process.

The housing 13 also includes a depression location 19 which has a size and shape for receiving the optional cradle assembly, described in more detail below, which is used for hands-free operation of the razor sharpener. The depression location 19 includes a fastener receptacle 21 for securing the cradle assembly to the housing 13. Preferably, the fastener receptacle 21 is threaded to accept and secure a support screw (not shown), thereby affixing the cradle assembly to the housing 13. A pushbutton switch 23 extends through the housing 13 and serves to electronically activate the razor sharpener 11. The switch 23 may also be used to deactivate the razor sharpener 11.

Figure 2:
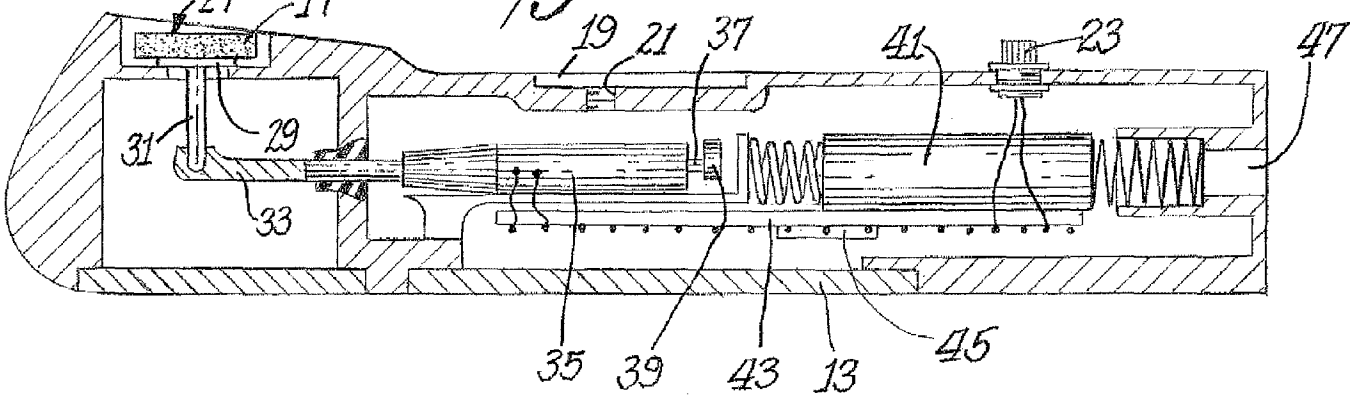
FIG. 2 is a cross sectional view of the razor sharpener of FIG. 1.

FIG. 2 shows the interior of the housing 13 and the operational parts enclosed therein. The sharpening assembly 27 includes the sharpening member 17, a mounting plate 29 to which the sharpening member 17 is affixed, and a sharpener shaft 31 supporting the mounting plate 29. The sharpening shaft 31 is coupled to and extends from a motor arm 33, which in turn is directly coupled to the motor 35. A motor shaft 37 extends from the opposite side of the motor 35, with a weight 39 eccentrically mounted thereto. Power to the motor is provided from a rechargeable battery 41 through control circuitry on a printed circuit board 43, although a non-rechargeable battery or an external power source may also be used. Power to the motor is activated via the pushbutton switch 23, which activates the timing circuit 45, included on the circuit board 43. An access port 47 is open in the housing 13 near the rechargeable battery 41 so that an external battery charger (not shown) may be connected to the rechargeable battery 41.

Upon activation, the timing circuit 45 powers the motor 35 for a predetermined amount of time, referred to herein as the sharpening cycle, after which the operation ceases. During use with a disposable safety razor, when the razor is held against the sharpening member 17 in a cutting position, i.e., the position in which such a disposable safety razor is typically held for shaving the human face, sonic vibrations generated at the sharpening member 17 by rotation of the eccentric weight 39 hones and removes microscopic burrs from the razor edge. Specifically, the motor assembly transmits sonic vibrations to the sharpening assembly 27, with the direction of vibration of the sharpening member 17 being along the cutting edges of the razor blades. Experimental trials have shown that a razor blade edge subjected to sonic vibration from the assembly described above causes the edge to return to a highly sharp condition following a sharpening cycle of approximately 15 to 25 seconds, thereby significantly extending the razor blade life. The sharpening cycle may run for 30-45 seconds if desired. Those skilled in the art will recognize that longer or shorter sharpening cycles may be used. In addition, with such a short sharpening cycle, tests have shown that the razor sharpener 11 can operate about two and one half months before without the need for recharging the rechargeable battery 41. Moreover, while some technical reports indicate that the consumer may expect to get fewer than 15 clean shaves out of a new disposable razor, tests have shown that the same disposable razors may provide as many as 75 or more clean shaves when regularly sharpened using the razor sharpener disclosed herein. This five-fold increase in performance for a disposable razor represents a substantial improvement in blade life performance.

Figure 3:
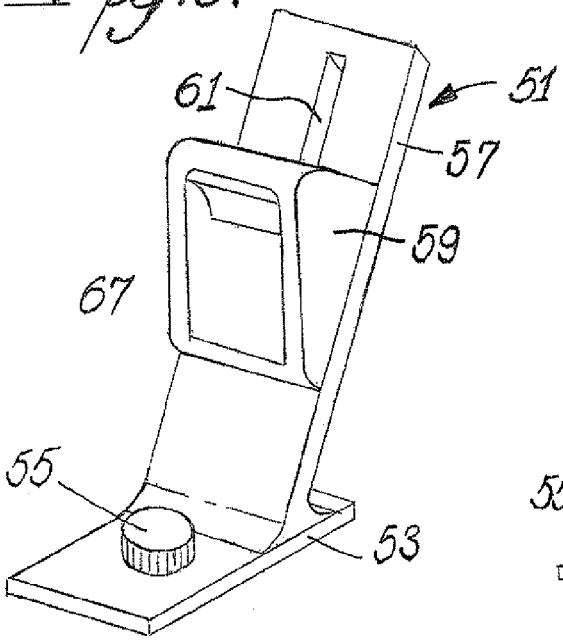
FIG. 3 is a pictorial view of a cradle assembly for the razor sharpener of FIG. 1.
Figure 4:
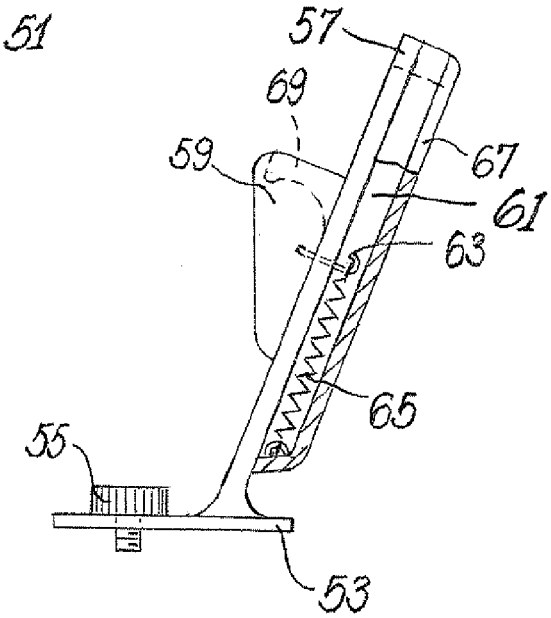
FIG. 4 is a partial sectional view of the cradle assembly of FIG. 3.

A user of the razor sharpener 11 shown in FIG. 1 would need to hold a disposable razor with the blades positioned in a cutting position against the sharpening surface 17 during the sharpening cycle. FIG. 3 illustrates a cradle assembly 51 which enables use of the razor sharpener 11 in a hands free mode. The cradle assembly 51 includes a base 53, which is sized to fit into the depression location 19 in the housing 13, a thumb screw 55, which is used to engage the fastener receptacle 21 in the housing 13, an extension arm 57, and a cradle 59. Referring also to FIG. 4, the extension arm 57 includes a slot 61, and the cradle 59 includes a hook 63 extending through the slot 61. The slot 61 enables the cradle 59 to slidably engage the extension arm 57, thereby permitting the cradle 59 to move toward and away from the housing 13 to accommodate disposable razors having different handle lengths. A spring 65 is disposed within a rear enclosure 67 on the backside of the extension arm 57. The spring 65 connects between the hook to a portion of the extension arm 57 near the base 53. Connected in this manner, the spring 65 biases the position of the cradle 59 toward the base 53, and thus toward the housing 13 when the cradle assembly 51 is mounted thereto. The cradle 59 extends away from the extension arm 51 to form a tapered receptacle 69. The tapering enables the receptacle 69 to receive and hold disposable razor handles having different shapes and outer dimensions.

Figure 5:
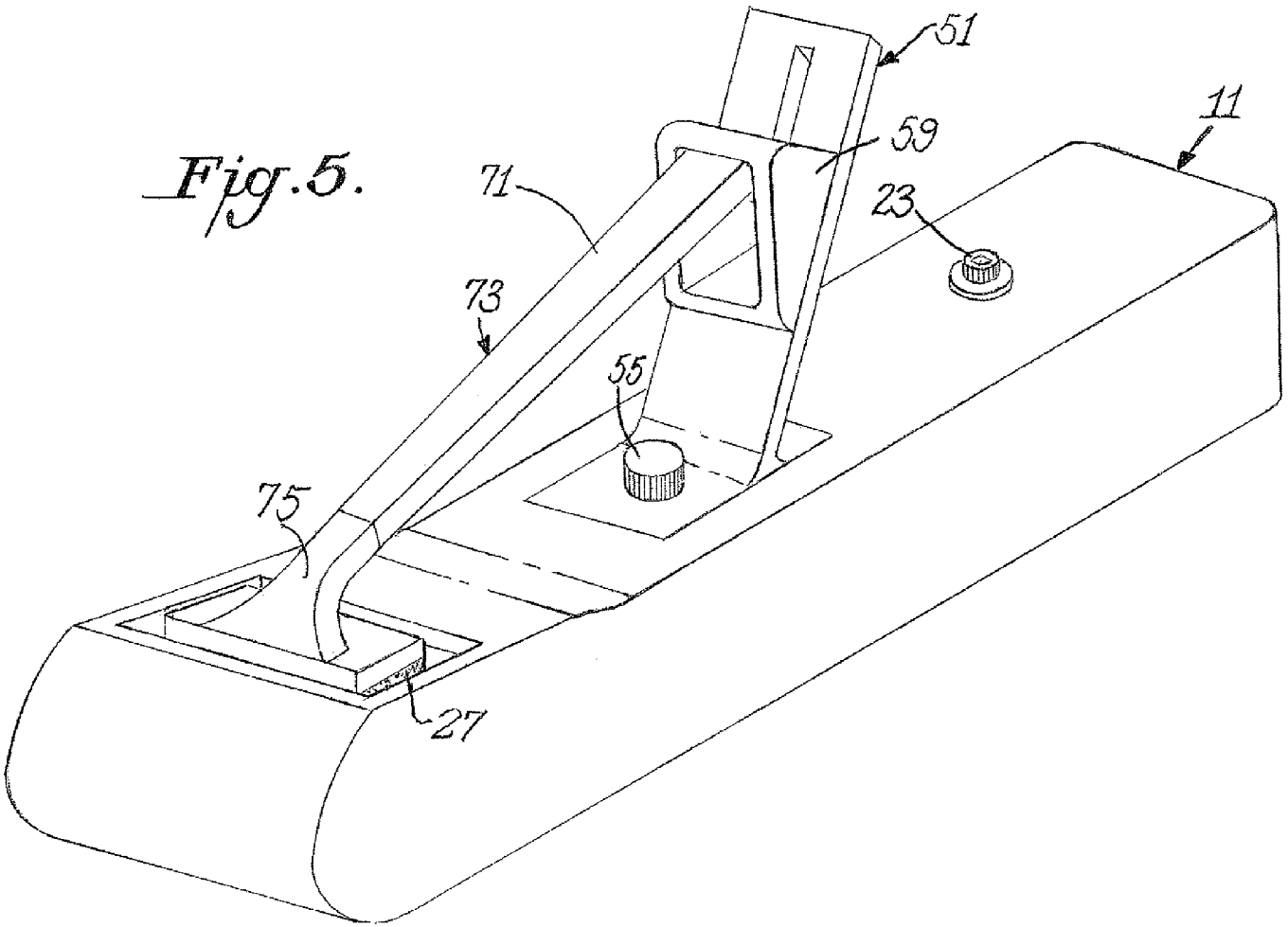
FIG. 5 is a pictorial view of a razor sharpener shown with a hand held razor held in position for sharpening.

FIG. 5 shows the razor sharpener 11 with the carriage assembly 51 mounted thereto. The carriage assembly 51 engages the handle 71 of a disposable razor 73 such that the head 75 of the disposable razor 73 is held in a cutting position against the sharpening member 27.

Thus, a razor blade sharpener is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. An apparatus for sharpening a cutting edge of one or more razor blades secured within a holder, the holder having a head for retaining the one or more razor blades in a cutting position and a handle affixed to the head, the apparatus comprising:

a housing having a razor slot adapted to receive the head;

a sharpening assembly disposed in the housing and including a sharpening member positioned adjacent the razor slot, wherein the sharpening member is adapted to engage the cutting edge of the one or more razor blades in the cutting position;

a motor assembly disposed in the housing and coupled to the sharpening assembly, wherein the motor assembly is adapted to transmit a high frequency vibration to the sharpening assembly, with a direction of vibration of the sharpening member being along the cutting edge of the one or more razor blades.

2. The apparatus of claim 1, wherein the motor assembly comprises:

a motor;

a motor arm coupling the motor to the sharpening assembly;

a motor shaft; and a weight eccentrically mounted to the motor shaft.

3. The apparatus of claim 1, further comprising a cradle assembly mounted to the housing and adapted to engage a distal end of the handle such that the head is held in the cutting position against the sharpening member.

4. The apparatus of claim 3, wherein the cradle assembly comprises an arm affixed to and extending away from the housing and a cradle secured in sliding relationship to the arm such that the cradle is movable toward and away from the housing, wherein the cradle is adapted to engage the distal end of the handle.

5. The apparatus of claim 4, further comprising a spring adapted to bias the cradle toward the housing.

6. The apparatus of claim 4, wherein the cradle is tapered to accommodate handles of varying diameters.

7. The apparatus of claim 1, wherein the motor assembly is adapted to cause linear vibrational movement of the sharpening member.

8. The apparatus of claim 1, further comprising control circuitry electronically coupled to the motor.

9. The apparatus of claim 8, wherein the control circuitry comprises:

a timing circuit electronically coupled to the motor and adapted to control power to the motor; and a switch electronically coupled to the timing circuit and adapted to activate the timing circuit.

10. The apparatus of claim 9, wherein the timing circuit is adapted to provide power to the motor for a predetermined period of time following activation.

11. The apparatus of claim 8, further comprising a rechargeable battery electronically coupled to the control circuitry.

* * * * *